United States Patent [19]

Rosin

[11] 4,135,750

[45] Jan. 23, 1979

[54] DEVICE FOR RETRIEVING DOG FECES, AND THE LIKE

[76] Inventor: Stanley A. Rosin, 115 S. Indian Ave., Palm Springs, Calif. 92262

[21] Appl. No.: 861,668

[22] Filed: Dec. 19, 1977

[51] Int. Cl.[2] ..... A01K 29/00

[52] U.S. Cl. ..... 294/19 R; 294/1 R

[58] Field of Search ..... 294/1 R, 19 R, 19 A, 294/50.6, 50.7, 50.8, 55, 99 R; 15/104.8, 257.1, 257.6; 56/332; 248/95, 99

[56] References Cited

U.S. PATENT DOCUMENTS

| | | | |
|---|---|---|---|
| 492,824 | 3/1893 | McLean | 56/332 |
| 3,716,263 | 2/1973 | Gatti | 294/19 R |
| 3,802,728 | 4/1974 | Giacopelli | 294/1 R X |
| 3,984,139 | 10/1976 | Battaglia | 294/1 R X |

*Primary Examiner*—Johnny D. Cherry
*Attorney, Agent, or Firm*—Keith D. Beecher

[57] ABSTRACT

A simple and convenient device is provided for retrieving dog feces. The device has an elongated handle, and a receptacle mounted at the lower end of the handle. The receptacle has an open bottom which is intended to receive a disposable bag. The disposable bag is provided with a rubber band encased about its mouth, and the rubber band normally draws the mouth to a closed condition. The rubber band is stretched around four releasable support members which are positioned above the periphery of the receptacle, and the bag is inserted into the receptacle. A first release member is provided which is connected to two of the support members which are positioned diagonally opposite one another, and a second relase member is provided for the other two of the support members which, likewise, are diagonally positioned with respect to one another. When the first release member is operated, the first two support members release the rubber band and cause it to snap the mouth of the bag within the receptacle to a closed position. Then, when the second release member is operated, the remaining two support members release the rubber band and permit the bag to fall out through the bottom of the receptacle.

6 Claims, 4 Drawing Figures

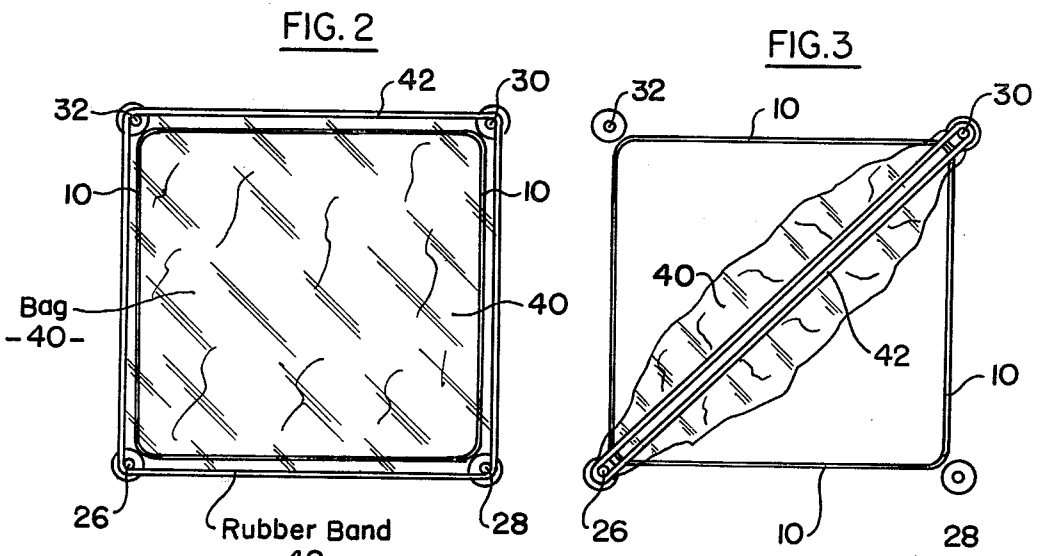
FIG. 3
FIG. 2
Rubber Band -42-
Bag -40-
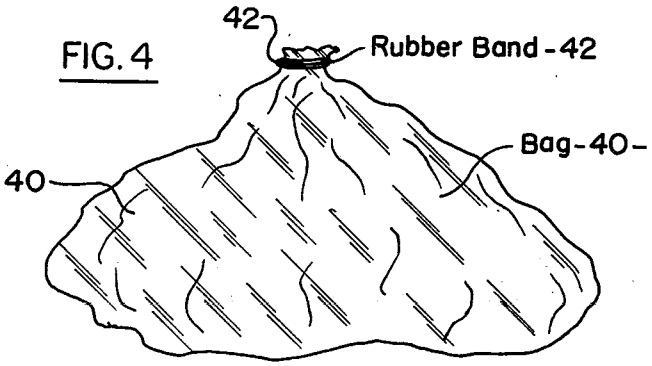
Rubber Band -42
Bag-40-
FIG. 4
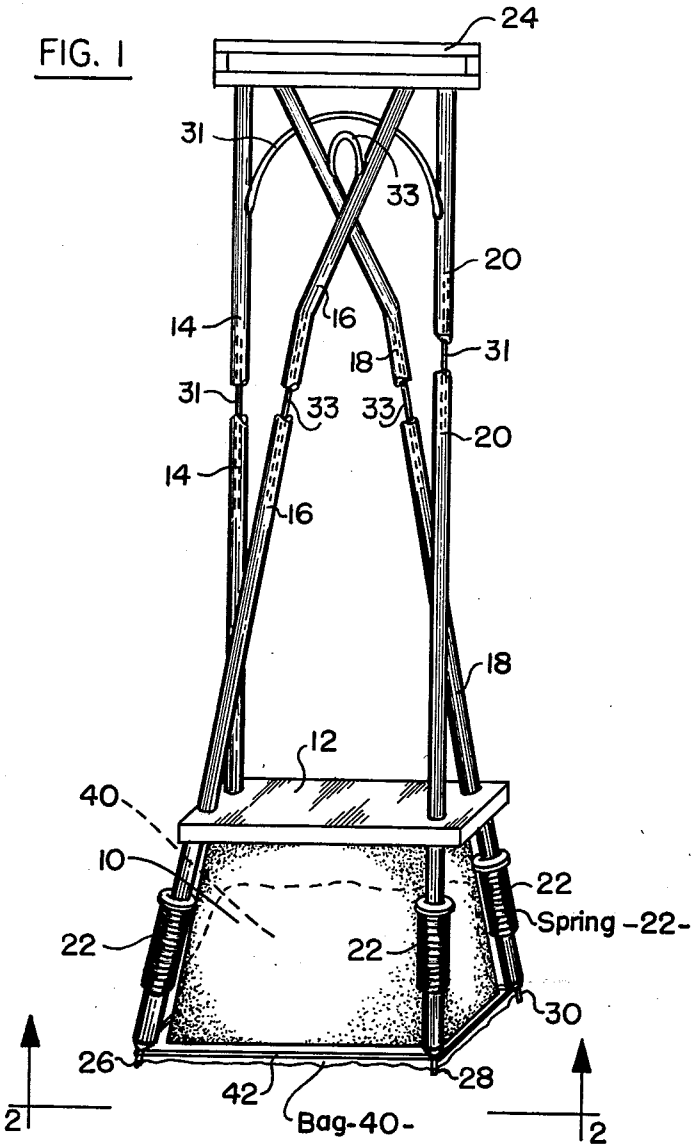
FIG. 1
Spring -22-
Bag-40-

DEVICE FOR RETRIEVING DOG FECES, AND THE LIKE

BACKGROUND OF THE INVENTION

Although dogs are extremely popular, they create problems in that their feces is a tremendous nuisance in public thoroughfares and on other person's property when the dogs are taken for a walk; and in that the feces also is a nuisance on the owner's property when the dogs are permitted to run in the back yard or garden.

The purpose of the present invention is to provide a simple and inexpensive device which may be easily loaded with a disposable plastic bag, or the like, and which may be easily carried and operated. The device, as explained above, includes a handle with a receptacle at its lower end, the receptacle having an open bottom which receives the disposable plastic bag. As also explained, a rubber band extends around the mouth of the bag, and the rubber band is looped around the four releasable supporting members at the periphery of the receptacle.

In operation, the device is set over the feces and the first release means is operated. This causes the rubber band to snap and close the mouth of the bag within the receptacle with the feces being trapped inside the bag. The device is then carried to an appropriate disposal container, such as a garbage can, and the second release means is operated. This causes the closed bag containing the feces to drop out of the receptacle and into the garbage can.

An advantage of the device of the invention is that there is no mess since the feces is contained entirely within the bag and never comes in contact with the receptacle itself. Another advantage is that the bags can be conveniently loaded in the device, and the device is easy and convenient to operate. Yet another advantage is the fact that the device is simple and economical in its construction, and it may be constructed of light materials to be readily portable.

BRIEF DESCRIPTION OF THE DRAWING

FIG. 1 is a side perspective view of a feces retrieving device constructed in accordance with one embodiment of the invention;

FIG. 2 is a bottom view of the device of FIG. 1 taken essentially along the line 2—2, and showing a disposable plastic bag in place within the device;

FIG. 3 shows the disposable bag with its mouth snapped closed after the release of one of the support means contained in the device of FIG. 1; and FIG. 4 is a view of the disposable bag after it has been released from the device.

DETAILED DESCRIPTION OF THE ILLUSTRATED EMBODIMENT

In the embodiment shown in FIG. 1, the device of the invention includes a rectangular-shaped receptacle 10 which is mounted on the underside of a platform 12, and which has an open bottom. Four elongated tubular members 14, 16, 18 and 20 extend through the platform 12. A handle 24 is connected to the upper ends of the tubular members. Although the receptacle 10 is shown as rectangular, it may have other shapes, for example, it may have a diamond, or other appropriate shape.

A group of four spring-loaded pins 26, 28, 30 and 32 are mounted at the respective corners of the receptacle 10, to project downwardly beyond the lower rim of the receptacle. A first elongated flexible release member 31 extends downwardly through the tubular members 14 and 20 to be attached to the upper ends of the spring-loaded pins 28 and 32. The release member 31 extends out from the sides of the tubular members 14 and 20 to form a loop adjacent to the handle 24 for convenient manual actuation of the release member.

A similar release member 33 extends downwardly through the tubular members 16 and 18, and it is attached to the spring-loaded pins 26 and 30. The release member 33 likewise is an elongated flexible member, and it extends through openings in the sides of the tubular members 16 and 18 to provide a second loop adjacent to the handle 24.

The bottom of the receptacle 10 is open, as mentioned above, and a disposable plastic bag 40 is loaded into the receptacle through its open bottom. The plastic bag 40 has a rubber band 42 extending around its mouth, and encased in an appropriate peripheral seam. When the bag is loaded into the receptacle 10, the rubber band extends around the sring-loaded pins 26, 28, 30 and 32, as shown in FIG. 2. The pins are loaded by springs 22.

Then, when the release member 31 is pulled upwardly, the pins 28 and 32 release the rubber band 42, so that the rubber band snaps the mouth of the bag 40 to a closed condition, as shown in FIG. 3. Therefore, to operate the device, it is set down over the feces, and, for example, the release member 31 is pulled so that the bag 40 snaps to the closed position of FIG. 3, with the feces entrapped in the bag.

However, the bag is still retained in the receptacle 10, and the device may be carried to any appropriate disposable site, such as a garbage can, or other site. Then, the release means 33 is pulled to cause the pins 26 and 30 to release the rubber band 42, so that the rubber band assumes the configuration shown in FIG. 4, and the bag containing the feces drops from the device into the disposal site.

It will be appreciated that there is no particular order in which the two release members 31 and 33 may be operated. If either one is operated first, the bag snaps to a closed position, such as shown in FIG. 3, and then when the second release member is operated, the bag is released and drops from the device.

As pointed out above, an advantage of the device of the invention is that the feces never comes in contact with the receptacle itself, or with any other part of the device. The feces is completely trapped and enclosed in the disposable bag, and is then dropped into the garbage can, or other disposal means. A new disposable bag may then be loaded into the device merely by causing its rubber band 42 to engage the pins 26, 28, 30 and 32, as shown in FIG. 2, and by pushing the bag 40 into the receptacle 10 through its open mouth.

Although the device of the invention is shown with an elongated rigid handle, so as to simulate to some extend a cane, it is conceivable that the device could be made without such as rigid handle, so as to be carried as a purse or handbag.

It will be appreciated, therefore, that while a particular embodiment of the invention has been shown and described, modifications may be made. It is intended in the claims to cover the modifications which come within the spirit and scope of the invention.

What is claimed is:

1. A device for retrieving dog feces, and the like, comprising: a receptacle having an open bottom for receiving a disposable bag, said bag having a rubber band encircling the mouth thereof; a plurality of releasable support means mounted at predetermined positions around the periphery of the receptacle for engaging the rubber band and for supporting the disposable bag within the receptacle; a first release means connected to a first group of said support means and actuable to cause said first group of support means to release the rubber band and enable the rubber band to close the mouth of the disposable bag; and second release means connected to a second group of said support means and actuable to cause said second group of support means to release the rubber band and cause the disposable bag to fall out through the open bottom of the receptacle.

2. The device defined in claim 1, and which includes an elongated handle means connected to the upper end of the receptacle and in which the first and second release means extend up the handle means to the upper end thereof.

3. The device defined in claim 1, in which the receptacle has a rectangular shape, and which includes four releasable support means respectively positioned at the corners of the receptacle.

4. The device defined in claim 3, in which the first release means controls a first two of the support means which are diagonally positioned with respect to one another, and the second release means control the remaining two of the support means which likewise are diagonally positioned with respect to one another.

5. The device defined in claim 1, in which the support means each comprises a spring-loaded downwardly extending pin.

6. The device defined in claim 5, in which the first and second release means each comprises an elongated flexible member whose ends are connected to respective ones of the spring-loaded pins.

* * * * *